US006338542B1

(12) United States Patent
Fujimori

(10) Patent No.: US 6,338,542 B1
(45) Date of Patent: Jan. 15, 2002

(54) PRINTING APPARATUS, METHOD OF PRINTING, AND RECORDING MEDIUM

(75) Inventor: Yukimitsu Fujimori, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/679,866

(22) Filed: Oct. 5, 2000

Related U.S. Application Data

(63) Continuation of application No. PCT/JP00/00634, filed on Feb. 4, 2000.

(30) Foreign Application Priority Data

Feb. 5, 1999 (JP) ..... 11-028502

(51) Int. Cl.[7] ..... B41J 2/15; B41J 2/145; B41J 29/38

(52) U.S. Cl. ..... 347/40; 347/10

(58) Field of Search ..... 347/40, 43, 57, 347/9, 10

(56) References Cited

U.S. PATENT DOCUMENTS 6,003,970 A * 12/1999 Fujita et al. ..... 347/41
6,149,263 A * 11/2000 Nakano ..... 347/43

FOREIGN PATENT DOCUMENTS

JP 9-0011457 1/1997

* cited by examiner

*Primary Examiner*—Thinh Nguyen
(74) *Attorney, Agent, or Firm*—Oblon, Spivak, McClelland, Maier & Neustadt, P.C.

(57) ABSTRACT

A technique applicable to a printer which enables a plurality of print modes having different printing speeds and picture qualities to be set flexibly. A printer has a high-quality print mode that enables printing at a high resolution to ensure a high picture quality and a high-speed print mode that enables printing at a low resolution but at a high speed. The printer has a first oscillator that outputs driving waveforms to create smaller-sized dots directed to the high-quality print mode, and a second oscillator that outputs driving waveforms to create larger-sized dots directed to the high-speed print mode. In addition to these two print modes, there is an intermediate print mode that utilizes both the first and the second oscillators to carry out printing at a low resolution. The intermediate print mode outputs driving waveforms in a sequence of a first series of waveforms and a second series of waveforms to respective pixels in a first pass of main scan and outputs the driving waveforms in a reverse sequence to the respective pixels in a second pass of main scan to create dots. This arrangement ensures the print mode having the low resolution to have improved picture quality.

9 Claims, 12 Drawing Sheets

PRINTING APPARATUS, METHOD OF PRINTING, AND RECORDING MEDIUM

CROSS-REFERENCE TO RELATED DOCUMENTS

The present document is a continuation of and claims priority on PCT/JP00/00634 filed on Feb. 4, 2000, which in turn claims priority on Japanese Patent Application 11-28502, filed on Feb. 5, 1999, the entire contents of each of which are hereby incorporated by reference.

BACKGROUND OF THE INVENTION

1. Field of the Invention

The present invention relates to a printing apparatus that creates dots to print an image on a printing medium. More specifically the present invention pertains to a printing apparatus that is capable of arbitrarily creating different types of dots in respective pixels.

2. Discussion of the Background

A diversity of printers have widely been used to print multi-color, multi-tone images as an output device of a computer. One of such printers is an ink jet printer that creates dots with several color inks ejected from a plurality of nozzles provided on a print head, so as to record an image. The ink jet printer generally enables expression of only two tones, that is, a dot-on state and a dot-off state, in each pixel. The ink jet printer accordingly carries out halftone processing, which expresses multiple tones of original print data by a distribution of dots, prior to printing an image.

Multi-valued printers that enable tone expression of greater than two values, the dot-on state and the dot-off state, have been proposed to attain richer tone expression. The multi-valued printers include printers that create dots with different quantities of ink and printers that create a plurality of dots in each pixel in an overlapping manner to express multiple tones. The multi-valued printers ensure a smoother tone expression and high-quality printing.

It is desirable, on the other hand, that the printer attains the desired printing speed and picture quality according to the requirements of the user. In order to meet such requirements, the printer typically has a diversity of print modes, for example, a high-speed print mode and a high-quality print mode. Some multi-valued printers may create different types of dots in respective print modes, in order to attain the desired printing. Such printers mainly use larger-sized dots that enable a solid area to be sufficiently formed in pixels of a relatively low resolution in the high-speed print mode. In the high-quality print mode, on the other hand, such printers mainly use smaller-sized dots corresponding to a relatively high resolution. These dots are selectively used by changing over the driving waveform output to the print head according to the selected print mode.

The recent trend is, however, to further improve picture quality of the printers. This leads to printing at a higher resolution and increases the tone values expressible in each pixel. There is accordingly a significant difference between the printing speed and the picture quality in the high-speed print mode and the printing speed and the picture quality in the high-quality print mode. The user may require a diversity of other print modes, for example an intermediate print mode that carries out printing at an intermediate picture quality and an intermediate printing speed between those of the high-quality print mode and the high-speed print mode.

It is extremely difficult to provide a print head that stably creates dots in response to a diversity of driving waveforms corresponding to respective print modes. Providing the driving waveforms corresponding to the respective print modes leads to an increase in the number of circuits generating the driving waveforms with an increase in the number of print modes. This undesirably raises the manufacturing cost of the printer. The background art printers can not sufficiently attain a required increase in number of print modes, because of these factors. The background art printers can thus not ensure printing that sufficiently fulfills the requirements of the user regarding the printing speed and the picture quality. This problem is found not only in the ink jet printers but in a variety of printers including multi-valued printers and two-valued printers.

SUMMARY OF THE INVENTION

An object of the present invention is thus to provide a technique that enables flexible setting of a print mode in a printing apparatus that ensures the expression of different densities in respective pixels according to the print mode.

At least part of the above and the other related objects is attained by a printing apparatus that moves a print head back and forth relative to one axis of a printing medium in response to a driving signal, so as to create a dot in each pixel and print an image on the printing medium. The printing apparatus includes "n" output units that periodically output driving signals corresponding to "n" different print modes (where n is an integer of not less than 2), in which different dots are created in each pixel and a mixing output unit that periodically uses "m" output units (where m is an integer satisfying $2 \leqq m \leqq n$), which are selected out of the "n" output units, thereby outputting a specific driving signal that is used in a specific print mode, which is different from any of the "n" different print modes.

In the printing apparatus of the present invention, a combination of at least two driving signals output from the "n" output units attains (n+1) or greater print modes. One example provides a first driving signal used in a print mode that carries out printing with two variable-size dots L1 and M1 (L1>M1), and a second driving signal used in a different print mode that carries out printing with two variable-size dots L2 and M2 (L2>M2). In the printing apparatus of the present invention, the mixing output unit periodically uses the first driving signal and the second driving signal, so as to attain a print mode using the four variable-size dots L1, L2, M1, and M2.

Here it is assumed that the print mode using the first driving signal is a high-speed print mode. In this case, the two variable-size dots L1 and M1 are relatively large-sized dots, so as to enable a solid area to be formed even in pixels of a relatively low resolution. In order to attain printing at a high speed, it is desirable to raise the driving frequency of the print head. In this print mode, the driving signal corresponding to the other variable-size dots L2 and M2, which are not used for printing, is not output to the print head.

The print mode using the second driving signal is a high-quality print mode. In this case, the two variable-size dots L2 and M2 are relatively small-sized dots to attain printing at a relatively high resolution. There are an extremely large number of pixels in the high-quality printing. In order to implement high-quality printing at a practical speed, it is desirable to keep the driving frequency of the print head at a sufficient level. In this print mode, the driving signal corresponding to the other variable-size dots L1 and M1, which are not used for printing, is not output to the print head.

A specific print mode attaining both an appropriate printing speed and an appropriate picture quality is provided, in addition to the above two print modes. The printing apparatus of the present invention combines the first driving signal with the second driving signal corresponding to the specific print mode. The specific print mode uses the relatively large-sized dots L1 and M1, and thus enables printing at a low resolution equivalent to that in the high-speed print mode. The specific print mode also uses the relatively small-sized dots L2 and M2 as in the high-quality print mode and thus ensures smooth tone expression. The specific print mode accordingly attains an intermediate picture quality and an intermediate printing speed between those of the high-speed print mode and the high-quality print mode.

The printing apparatus of the present invention combines the output units, which are provided to output driving signals corresponding to preset print modes, in the above manner and thereby enables a driving signal to be output corresponding to a different print mode having a different printing speed and a different picture quality, without raising the manufacturing cost of the printing apparatus. The example discussed above addresses a case of setting a third print mode by combining two driving signals. The combination of driving signals is not restricted to the above example. Providing various combinations of three or more driving signals enables a wide range of print modes. The above example addresses a case of using two variable-size dots in each print mode. As long as different dots are used in respective print modes, each print mode may use only one variable-size dot.

In the printing apparatus of the present invention, for example, the mixing output unit carries out printing with "m" driving signals. In this case, it is possible to output one driving signal during one pass of the print head (hereinafter referred to as a pass of the main scan) and form each raster line by "m" passes of the main scan. It is, however, desirable that the mixing output unit periodically uses the "m" output units during one pass of the print head.

The printing apparatus thus constructed may output "im" driving signals consecutively in each pixel. This arrangement enables a driving signal corresponding to a print mode to be output during one pass of the print head, and prevents an unnecessary increase in number of back and forth movements of the print head to form each raster line. This results in preferably preventing an extreme decrease in printing speed.

In accordance with one preferable embodiment of the present invention, the mixing output unit causes the "m" output units to output driving signals over "m" pixels. In this embodiment, the printing apparatus further includes a control unit that controls the mixing output unit to output driving signals to ensure different mappings of the output units to respective pixels during "m" passes of the print head, thus enabling "m" different driving signals to be output with regard to each pixel.

This arrangement advantageously ensures the overlap effects as discussed below to improve the picture quality. This arrangement also enables the print head to be driven at a driving frequency equivalent to that of the print mode that uses each output unit alone. This advantageously ensures a wide range of combination of the output units without taking into account the restriction according to the driving frequency of the print head.

The advantage of ensuring the overlap effects is discussed below in one example with a combination of two driving signals. The term "overlap" means a method of forming each raster line using two or more dot-forming elements in a printing apparatus with a multi-head having a plurality of dot-forming elements. One available technique creates dots in pixels of odd ordinal numbers with a first dot-forming element and dots in pixels of even ordinal numbers with a second dot-forming element. Even if the dot-forming elements have a variation in position of dot formation, using the two or more dot-forming elements to print each raster line preferably prevents a positional misalignment of the whole raster line, thereby improving the picture quality.

In one recording method, the first pass of the main scan forms raster lines in response to the first driving signal, and the second pass of the main scan forms raster lines in response to the second driving signal. In this technique of dot formation, a raster line including only the dots corresponding to the first driving signal is completed by the first pass of the main scan. No dots are accordingly formed on this raster line by the second pass of the main scan. In this area, a resulting printed image has a picture quality equivalent to that of an image printed by one pass of the main scan. Namely there is no overlap effect.

Another recording method alternately outputs the first driving signal and the second driving signal during one pass of the main scan. The first pass of the main scan creates dots in the pixels of odd ordinal numbers in response to the first driving signal and dots in the pixels of even ordinal numbers in response to the second driving signal. The second pass of the main scan, on the contrary, creates dots in the pixel of odd ordinal numbers in response to the second driving signal and dots in the pixels of even ordinal numbers in response to the first driving signal. In a raster line including only the dots corresponding to the first driving signal, dots are created in the pixels of odd ordinal numbers by the first pass of the main scan and in the pixels of even ordinal numbers by the second pass of the main scan. This recording method thus ensures the overlap effects to improve the picture quality. This example addresses a case of combining two driving signals. Similar effects may, however, be exerted by combining three or more driving signals.

The following describes the advantage of ensuring the wide range of combination of output units without taking into account the restriction according to the driving frequency of the print head. The driving frequency of the print head generally has an upper limit according to the mechanism of the print head. In the arrangement of consecutively outputting two different driving signals and causing dots to be formed corresponding to both the two driving signals in each pixel in one pass of the main scan, one applicable method reduces the speed of the main scan according to the number of the driving signals. Another applicable method lowers the driving frequency of each driving signal, such that the consecutive output of the two driving signals satisfies the upper limit. The former method undesirably lowers the printing speed, whereas the latter method unnecessarily reduces the number of different dots in the print mode that uses each driving signal alone, so as to lower the picture quality. In either of these methods, the disadvantage becomes more significant with an increase in the number of driving signals combined.

The technique of the present invention combines two driving signals, such that dots are created in two pixels in response to the respective driving signals. This arrangement makes the driving frequency of the print head in the print mode using the combined driving signals equivalent to the driving frequency in the print mode using each driving signal alone. The technique is thus free from the disadvantages discussed above. This technique enables the number of driving signals combined to increase without any limitation in principle, thus ensuring a wide range of print modes.

In accordance with one preferable application of the printing apparatus of the present invention, the output unit outputs a driving signal of a specific frequency that corresponds to a maximum possible number of dots created in each pixel during one pass of the print head, in response to a driving frequency of the print head.

There is generally a restriction in size of dots possibly created by a single print head. A combination of plural dots created in each pixel extends the expressible density range in each pixel. The use of the specific driving signal corresponding to the maximum possible number of dots created in each pixel ensures an extremely wide range of tone expression using a plurality of dots, and thereby significantly improves the picture quality in any print mode.

In accordance with another preferable application of the printing apparatus of the present invention, at least one of the output units outputs a specific driving signal that enables a plurality of dots including a maximum-sized dot created by the print head to be formed in each pixel.

This arrangement raises the upper limit of the density expressible in each pixel, thus enabling a diversity of variable-size dots to be created and enriching the tone expression as a whole.

The technique of the present invention is actualized by a variety of applications other than the printing apparatus discussed above. For example, in the case that the printing apparatus includes a printer unit that ejects ink to implement printing and a printing controller that drives and controls the printer unit, the technique of the invention may be actualized by the printing controller that generates control data, which are supplied to the printer unit to implement printing according to any of the arrangements discussed above. The present invention is also directed to a method of printing and a method of controlling a printing operation. The technique of the present invention is also actualized by a recording medium, in which a program for driving the printing apparatus discussed above is recorded, as well as the program itself. Available examples of the recording medium include flexible disks, CD-ROMs, magneto-optic discs, IC cards, ROM cartridges, punched cards, prints with barcodes or other codes printed thereon, internal storage devices (memories like a RAM and a ROM), and external storage devices of the computer, and a variety of other computer readable media.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
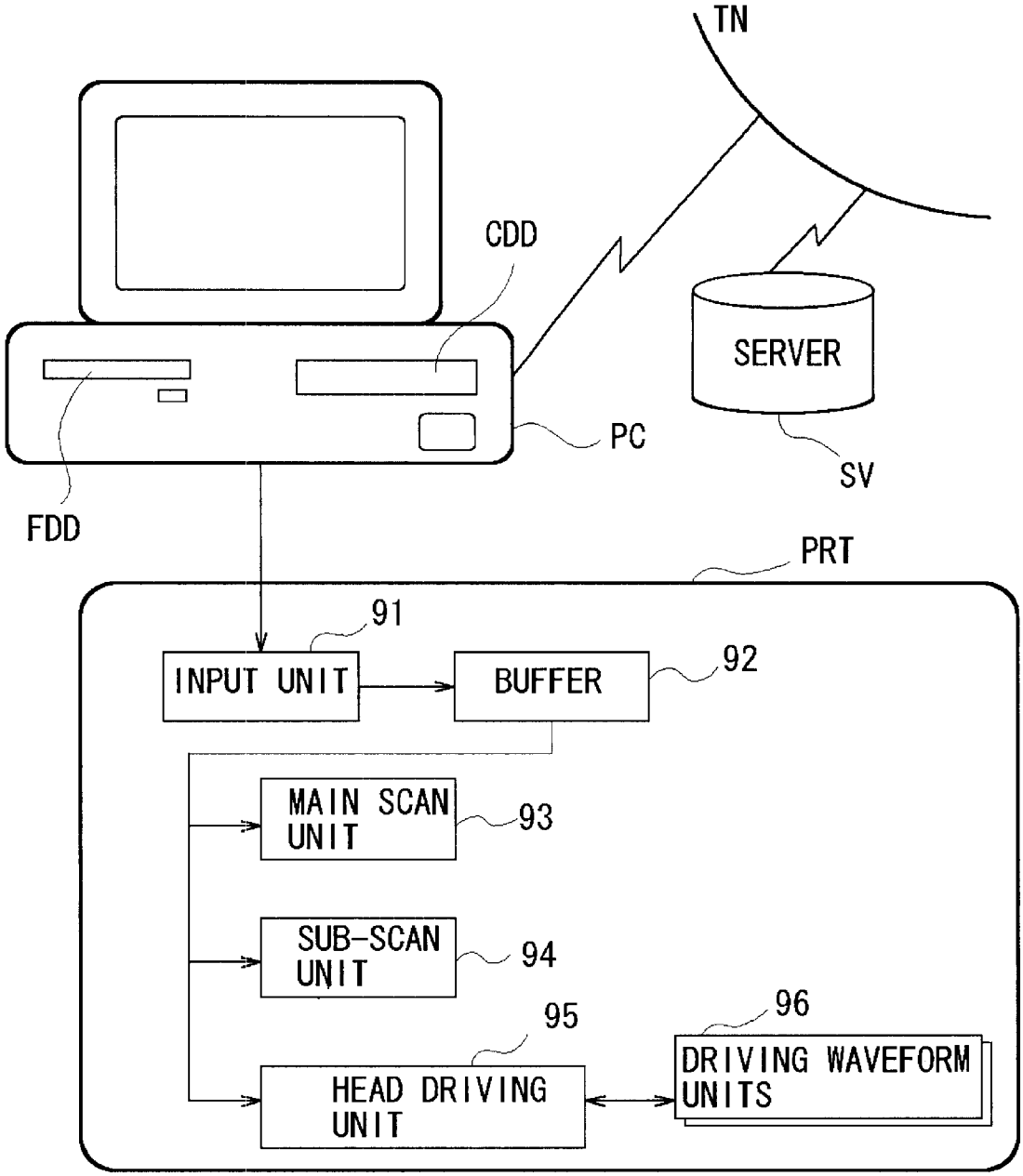
FIG. 1 schematically illustrates the structure of a printing system including a printer PRT of one embodiment of the present invention.

FIG. 1 illustrates the structure of a printing system including a printer PRT in one embodiment of the present invention. The printer PRT is connected to a computer PC and receives print data from the computer PC to carry out printing. The computer PC is connected with an external network TN and gains access to a specific server SV to download programs and data for driving the printer PRT. The required programs and data may alternatively be loaded from a flexible disk or a CD-ROM set in a flexible disk drive FDD or a CD-ROM drive CDD. Part of the loaded programs may be transferred to the printer PRT.

The functional blocks of the printer PRT are also shown in FIG. 1. The printer PRT includes an input unit 91, a buffer 92, a main scan unit 93, a sub-scan unit 94, a head driving unit 95, and driving waveform unit 96. The input unit 91 receives print data and print mode data from the computer PC and temporarily stores the input data into the buffer 92. The print data input from the computer PC specifies densities to be expressed by creating dots in respective pixels arranged in a two-dimensional manner. The main scan unit 93 carries out a main scan to move a head of the printer PRT back and forth relative to a sheet of printing paper based on the print data. The sub-scan unit 94 carries out a sub-scan to feed the printing paper in a direction perpendicular to the main scanning direction on the conclusion of every pass of the main scan. The head driving unit 95 drives the head of the printer during the main scan, based on the print data stored in the buffer 92, so as to create dots on the printing paper. As described later, the printer PRT of this embodiment creates a dot of different ink quantities or a plurality of dots in the respective pixels according to a print mode, thereby ensuring the expression of multiple densities. The types of dots created according to the print mode are determined by the driving waveform unit 96. The printer PRT has the two driving waveform units 96. The head driving unit 95 drives the head according to the print mode specified by the computer PC based on either one or both of these driving waveform units 96, so as to create dots in the respective pixels according to the print data.

Figure 2:
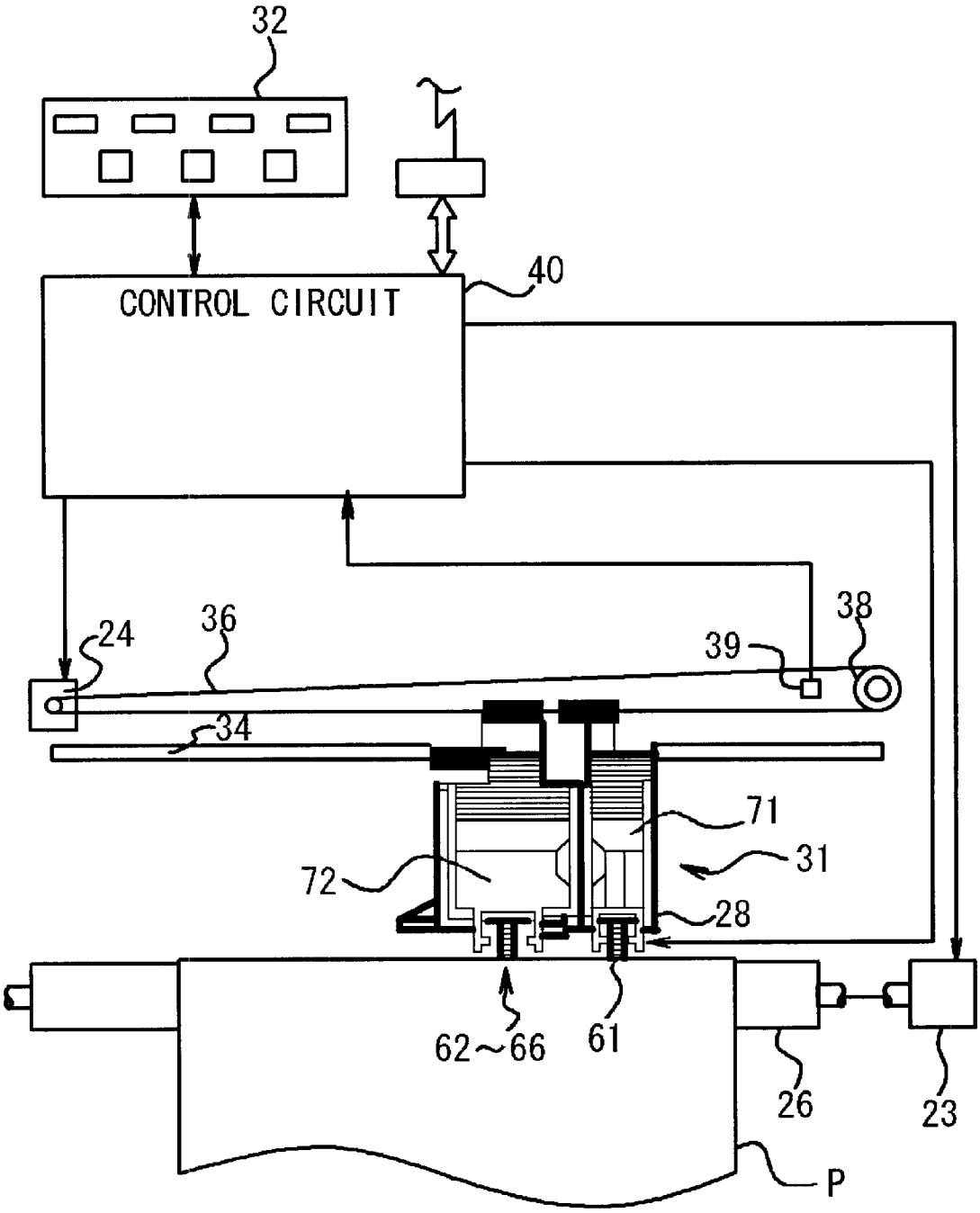
FIG. 2 schematically illustrates the structure of the printer PRT.

The structure of the printer PRT is schematically described with the drawing of FIG. 2. As illustrated, the printer PRT has a mechanism of feeding a sheet of printing paper P by means of a sheet feed motor 23, a mechanism of moving a carriage 31 forward and backward along an axis of a platen 26 by means of a carriage motor 24, a mechanism of driving a print head 28 mounted on the carriage 31 to implement ink ejection, and a control circuit 40 that controls transmission of signals to and from the sheet feed motor 23, the carriage motor 24, the print head 28, and a control panel 32.

The mechanism of reciprocating the carriage 31 along the axis of the platen 26 includes a sliding shaft 34 that is disposed in parallel with the axis of the platen 26 for slidably supporting the carriage 31, a pulley 38, an endless drive belt 36 that is spanned between the carriage motor 24 and the pulley 38, and a position sensor 39 that detects the position of the origin of the carriage 31.

A black ink cartridge 71 for black ink (K) and a color ink cartridge 72 in which five color inks, that is, e.g., cyan (C), light cyan (LC), magenta (M), light magenta (LM), and yellow (Y), are accommodated are detachably attached to the carriage 31. A total of six ink ejection heads 61 through 66 are formed on the print head 28 that is disposed in the lower portion of the carriage 31. When the ink cartridges 71 and 72 are attached to the carriage 31, supplies of inks are fed from the respective ink cartridges to the ink ejection heads 61 through 66.

Figure 3:
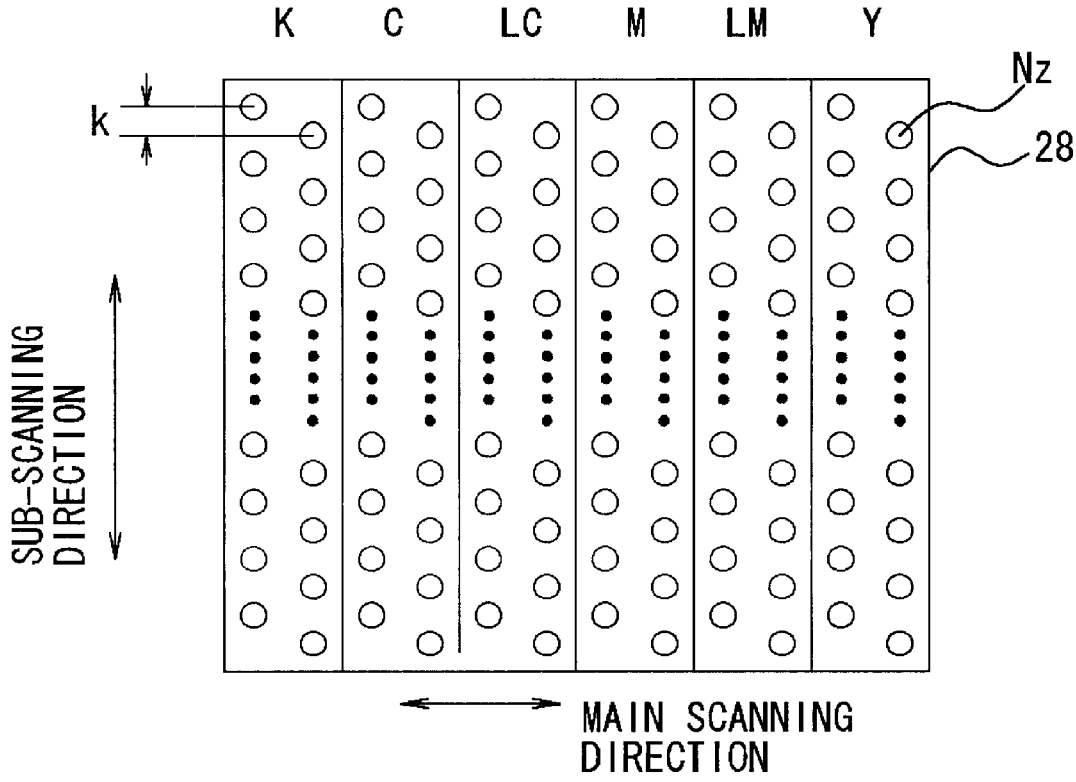
FIG. 3 shows an exemplified arrangement of nozzles in the printer PRT.

FIG. 3 shows an arrangement of nozzles in the respective ink ejection heads 61 through 66. The arrangement of nozzles includes six nozzle arrays, wherein each nozzle array ejects ink of each color and includes forty-eight nozzles Nz arranged in zigzag at a fixed nozzle pitch k. The positions of the corresponding nozzles in the respective nozzle arrays are coincident with one another in the sub-scanning direction.

Figure 4:
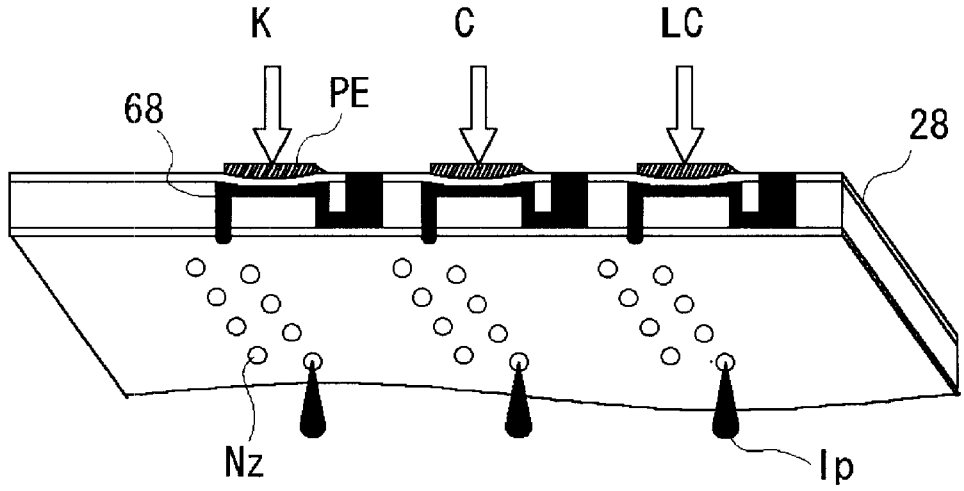
FIG. 4 shows the principle of dot formation in the printer PRT.
Figure 5:
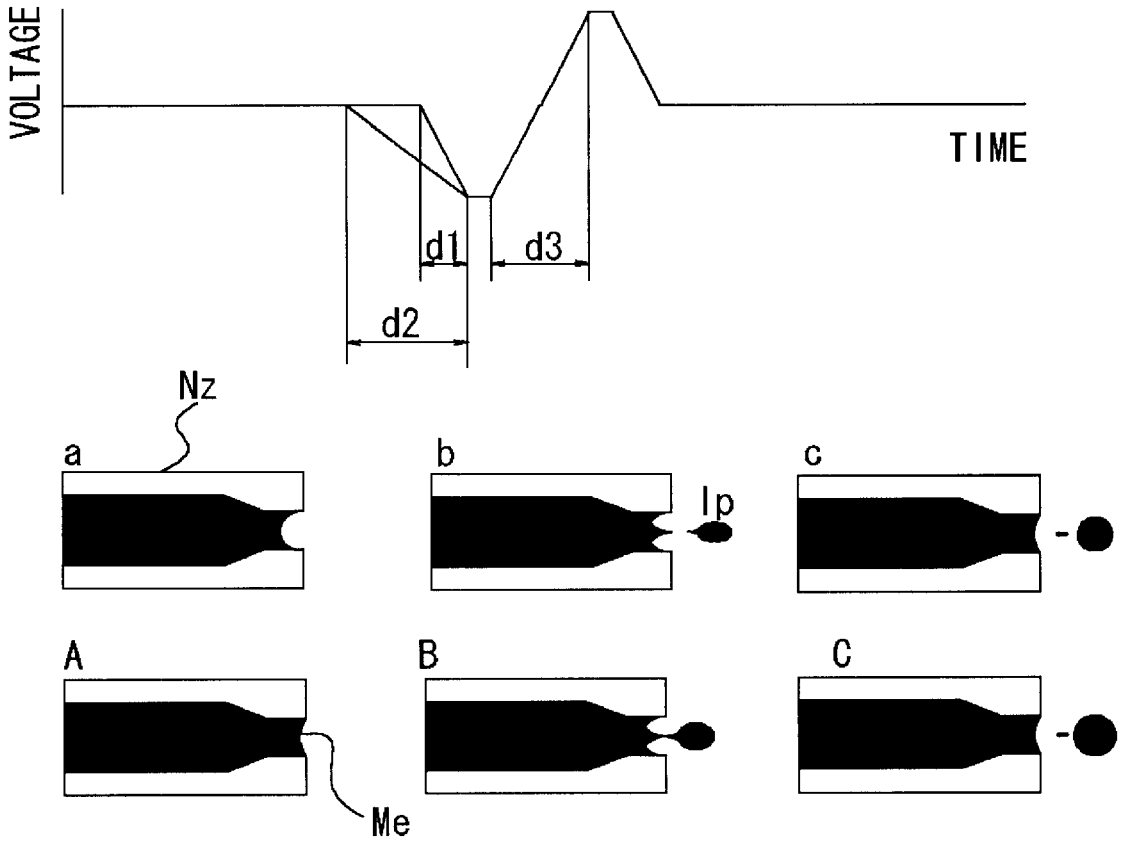
FIG. 5 shows a principle of creating dots having different quantities of ink.

The following describes the mechanism of ejecting ink. FIG. 4 schematically illustrates the internal structure of the print head 28. For the clarity of illustration, only the part relating to the ink ejection with regard to the three color inks K, C, and LC is shown. In the ink ejection heads 61 through 66, a piezoelectric element PE is provided for each nozzle. As shown in FIG. 4, the piezoelectric element PE is located to be in contact with an ink conduit 68, through which a supply of ink is fed to each nozzle Nz. As is known by those skilled in the art, the piezoelectric element PE deforms its crystal structure by application of a voltage and implements an extremely high-speed conversion of electrical energy into mechanical energy. In this embodiment, when a preset voltage is applied between electrodes on either end of the piezoelectric element PE for a predetermined time period, the piezoelectric element PE is expanded for the predetermined time period to deform one side wall of the ink conduit 68 as shown by the arrows in FIG. 4. The volume of the ink conduit 68 is reduced according to the expansion of the piezoelectric element PE. A certain amount of ink corresponding to the reduction is ejected as an ink particle Ip from the nozzle Nz at a high speed. The ink particles Ip soak into the printing paper P set on the platen 26, so as to implement printing The printer PRT applies voltages of different waveforms to the piezoelectric element PE, so as to create dots of different ink quantities. The following describes the principle of such a dot creation technique. FIG. 5 shows the relationship between the driving waveform of the nozzle Nz and the size of the ink particle Ip ejected from the nozzle Nz. The driving waveform shown by the broken line in FIG. 5 is used to create standard-size dots. Application of a voltage lower than a reference voltage to the piezoelectric element PE in a division d2 deforms the piezoelectric element PE in the direction of increasing the cross-section of the ink conduit 68. Since there is a limit in ink supply speed to the nozzle, the quantity of ink supply has an insufficiency relative to the expansion of the ink conduit 68. As shown in a state A of FIG. 5, an ink interface Me is thus slightly concaved inward the nozzle Nz. When the driving waveform shown by the solid line in FIG. 5 is used to abruptly lower the voltage in a division d1, on the other hand, the quantity of ink supply has a further insufficiency and the ink interface is more significantly concaved inward the nozzle Nz as shown in a state a, compared with the state A.

Subsequent application of a high voltage to the piezoelectric element PE (in a division d3) causes an ink droplet to be ejected based on the principle discussed previously. As shown in states B and C, a large ink droplet is ejected when the ink interface is only slightly concaved inward (state A). As shown in states b and c, on the other hand, a small ink droplet is ejected when the ink interface is significantly concaved inward (state a). The size of the dot to be created can thus be varied by changing the rate of decrease in driving voltage (see the divisions d1 and d2).

Figure 6:
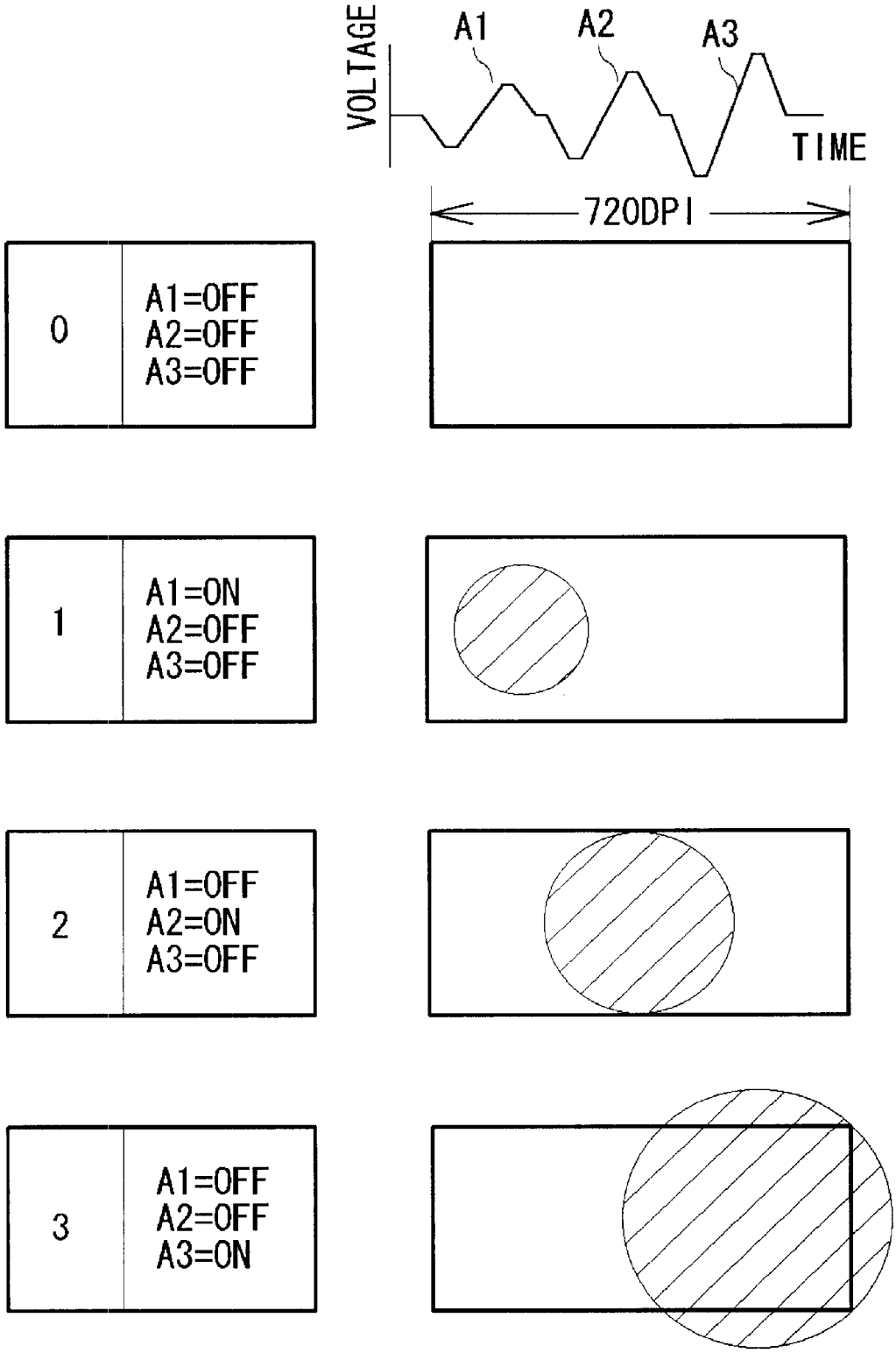
FIG. 6 shows a dot formation pattern with a first series of driving waveforms.

The printer PRT has two oscillators to output driving waveforms. FIG. 6 shows a first series of driving waveforms generated by a first oscillator. The first oscillator consecutively outputs three different types of driving waveforms A1, A2, and A3. The driving waveform A1 causes an ink droplet of 5 ng to be ejected to create a small-sized dot. The driving waveform A2 causes an ink droplet of 10 ng to be ejected to create a medium-sized dot. The driving waveform A3 causes an ink droplet of 20 ng to be ejected to create a large-sized dot. The first oscillator outputs the driving waveforms A1 through A3 at a specific frequency that ensures dot creation in response to any of these driving waveforms in an identical pixel.

In the example of FIG. 6, the small-sized dot, the medium-sized dot, and the large-sized dot are created at varying positions. These dots may, however, be formed at substantially identical positions by adjusting the jet speed of the respective ink droplets. In this case, the jet speed of the ink droplets should be adjusted to satisfy the relation "driving waveform A1<driving waveform A2<driving waveform A3" by taking into account the speed of the main scan.

FIG. 6 also shows the relationship between the dots created in response to such driving waveforms and print data. Each box represents one pixel. The first series of driving waveforms are mainly used in a high-quality print mode, and the pixel has a size corresponding to a high resolution of 720 dpi (dots per inch) in both the main scanning direction and in the sub-scanning direction. Although the pixel is shown as a rectangle for convenience of illustration, the pixel is actually a square. Different values may be set for the resolutions in the main scanning direction and in the sub-scanning direction.

When a tone value TN of the print data is equal to 0, all the driving waveforms A1 through A3 are set off to create no dot. When the tone value TN is equal to 1, only the driving waveform A1 is set on to create a small-sized dot. When the tone value TN is equal to 2, only the driving waveform A2 is set on to create a medium-sized dot. When the tone value TN is equal to 3, only the driving waveform A3 is set on to create a large-sized dot. The technique of this embodiment sets on only one of the driving waveforms A1 through A3 according to the tone value. A plurality of driving waveforms may, however, be set on to express some tone value. In the example of FIG. 6, the large-sized dot is created in response to the driving waveform A3. The large-sized dot may alternatively be created by setting both the driving waveforms A1 and A2 on, in place of the driving waveform A3.

Figure 7:
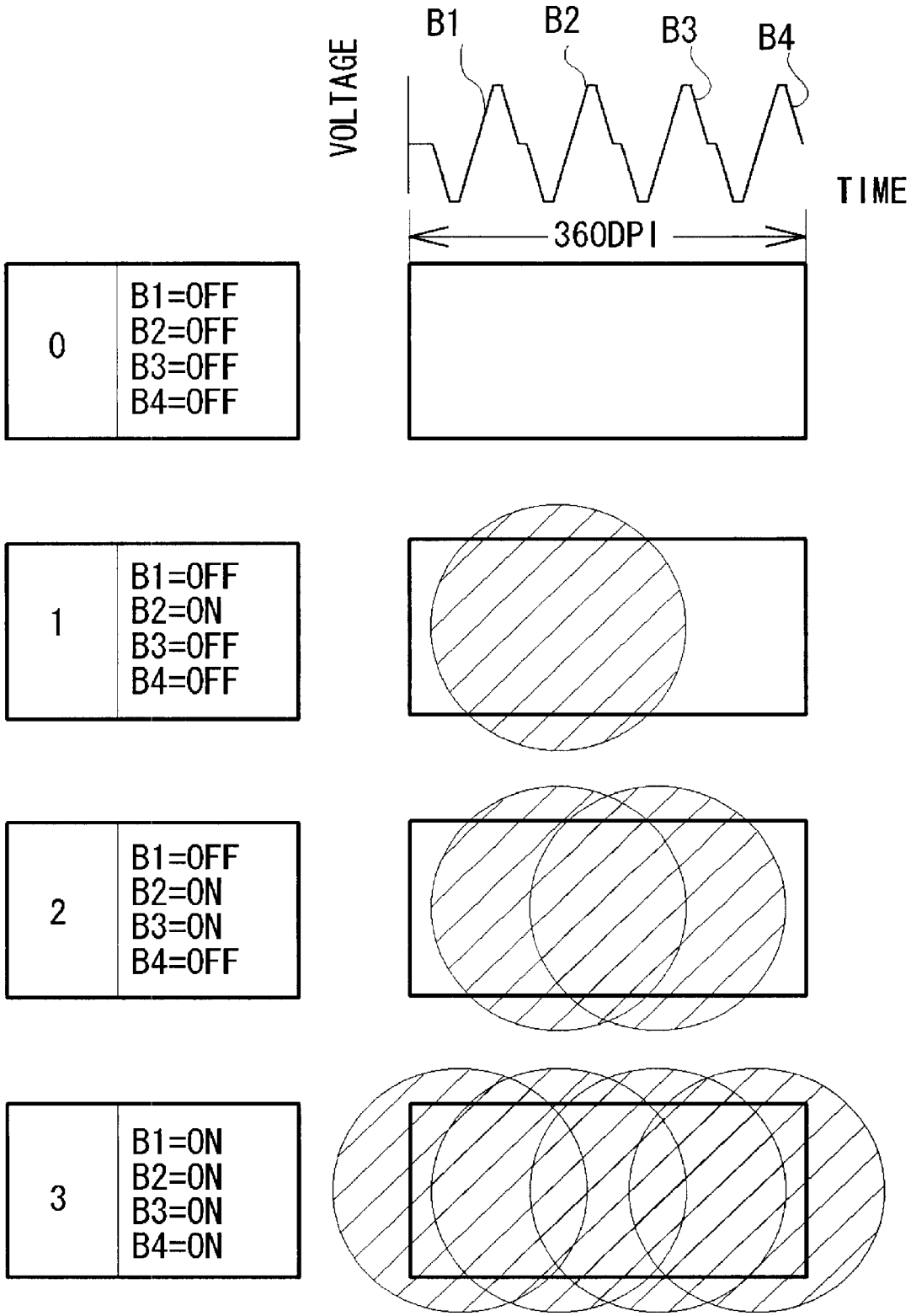
FIG. 7 shows a dot formation pattern with a second series of driving waveforms.

FIG. 7 shows a second series of driving waveforms generated by a second oscillator. The second oscillator outputs four driving waveforms. Namely the second oscillator outputs four driving waveforms B1 through B4. In this embodiment, the driving waveforms output from the second oscillator all cause an ink droplet of 20 ng to be ejected.

FIG. 7 also shows the relationship between the dots created in response to such driving waveforms and print data. Each box represents one pixel. The second series of driving waveforms are mainly used in a high-speed print mode, and the pixel has a size corresponding to a low resolution of 360 dpi in both the main scanning direction and in the sub-scanning direction. Although the pixel is shown as a rectangle for convenience of illustration, the pixel is actually a square. Different values may be set for the resolutions in the main scanning direction and in the sub-scanning direction.

When the tone value TN of the print data is equal to 0, all the driving waveforms B1 through B4 are set off to create no dot. When the tone value TN is equal to 1, only the driving waveform B2 is set on to create a dot of 20 ng. When the tone value TN is equal to 2, both the driving waveforms B2 and B3 are set on to create a dot of 40 ng. When the tone value TN is equal to 3, all the driving waveforms B1 through B4 are set on to create a dot of 80 ng. The second series of driving waveforms change the number of dots created in one pixel, so as to express the density according to the tone value.

The following describes the settings of the first series of driving waveforms and the second series of driving waveforms. As described previously, the first series of driving waveforms are used in the high-quality print mode. In the high-quality print mode, it is preferable to create small-sized dots having lower visual conspicuousness in pixels of the high resolution. Varying the quantity of ink ejection based on the principle discussed previously with the drawing of FIG. 5 ensures the multi-tone expression in each pixel while using relatively well-shaped dots. From these viewpoints, the waveform A1 corresponding to the smallest-sized dot based on the principle of FIG. 5, the waveform A3 corresponding to the largest-sized dot, and the intermediate waveform A2 are applied for the first series of driving waveforms. The variable range of the quantity of ink ejection based on the principle of FIG. 5 has a restriction, and the largest-sized dot is approximately four times the size of the smallest-sized dot.

The second series of driving waveforms are, on the other hand, used in the high-speed print mode. In the high-speed print mode, dots are created in pixels of the low resolution. In order to print a solid area adequately, it is required to create dots in pixels of a relatively large size with substantially no clearances. The driving waveform A3 described above corresponds to the largest-sized dot based on the principle of FIG. 5, and no greater dots are stably created. From these viewpoints, the second series of driving waveforms are set to ensure the multi-tone expression by varying the number of the largest-sized dots created in each pixel.

A diversity of other waveforms may be applicable for the first series of driving waveforms and the second series of driving waveforms by taking into account the settings of the nozzles and the resolution. For example, the first series of driving waveforms may include a plurality of waveforms corresponding to the driving waveform A3. The second series of driving waveforms may include a waveform that leads to the ejection of a smaller quantity of ink than those of the driving waveforms B1 through B4. Any suitable waveforms may be set in the respective print modes having different resolutions and printing speeds.

Figure 8:
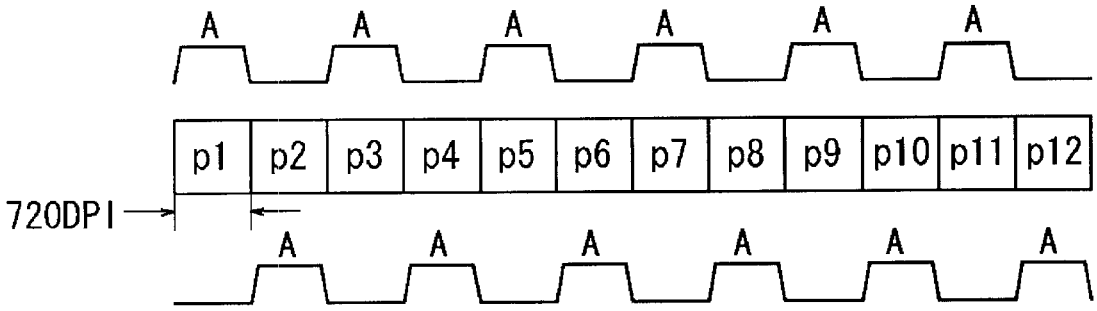
FIG. 8 shows an output of driving waveforms in a high-quality print mode.
Figure 9:
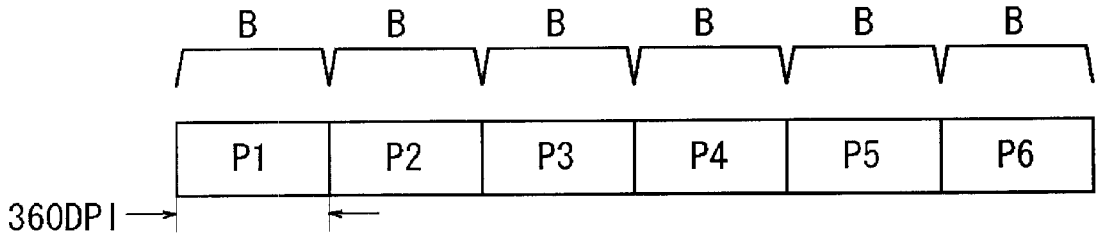
FIG. 9 shows an output of driving waveforms in a high-speed print mode.
Figure 10:
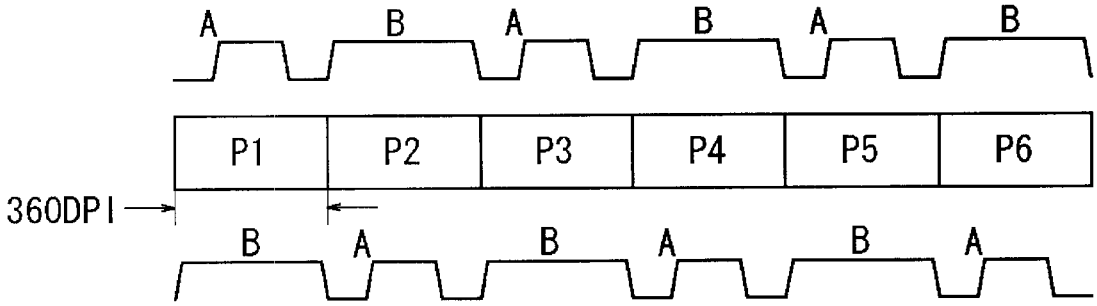
FIG. 10 shows an output of driving waveforms in an intermediate print mode.

The printer PRT enables printing in a total of three different print modes using the first series of driving waveforms and the second series of driving waveforms. The three print modes are the high-quality print mode using only the first series of driving waveforms, the high-speed print mode using only the second series of driving waveforms, and the intermediate print mode using both the first and second series of driving waveforms alternately. FIGS. 8 through 10 show the outputs of driving waveforms in the respective print modes.

FIG. 8 shows the output of driving waveforms in the high-quality print mode. Boxes p1 through p12 respectively represent pixels. As described above, in the high-quality print mode, printing is carried out at the resolution of 720 dpi in both the main scanning direction and the sub-scanning direction. The first series of driving waveforms are output at a frequency of once per two pixels. The driving waveforms are output in the periods with an alphabet A. Although not being illustrated specifically in FIG. 8, the period with the alphabet A includes the three driving waveforms shown in FIG. 6. The upper chart in FIG. 8 represents the timings of outputting the series of driving waveforms in a first pass of the main scan to carry out printing in the pixels p1 through p12. In response to the driving waveforms output in this manner, dots are created in pixels of odd ordinal numbers. The lower chart in FIG. 8 represents the timings of outputting the series of driving waveforms in a second pass of the main scan. In response to the driving waveforms output in this manner, dots are created pixels of even ordinal numbers. In this manner, each raster line is formed by two passes of the main scan in the high-quality print mode.

FIG. 9 shows the output of driving waveforms in the high-speed print mode. Boxes P1 through P6 respectively represent pixels. As described above, in the high-speed print mode, printing is carried out at the resolution of 360 dpi in both the main scanning direction and the sub-scanning direction. Although each pixel is shown by a rectangle for convenience of illustration, the pixel is actually a square. The second series of driving waveforms are output in every pixel. The driving waveforms are output in the periods with an alphabet B. Outputting the driving waveforms in each pixel as illustrated causes each raster line to be formed by one pass of the main scan in the high-speed print mode.

FIG. 10 shows the output of driving waveforms in the intermediate print mode. Boxes P1 through P6 respectively represent pixels. As described above, in the intermediate print mode, printing is carried out at the resolution of 360 dpi in both the main scanning direction and the sub-scanning direction. Although each pixel is shown by a rectangle for convenience of illustration, the pixel is actually a square. In the intermediate print mode, the first series of driving waveforms and the second series of driving waveforms are output alternately in the respective pixels. The upper chart of FIG. 10 shows the timings of outputting the series of driving waveforms in a first pass of the main scan. Dots are created in pixels of odd ordinal numbers in response to the first series of driving waveforms and in pixels of even ordinal numbers in response to the second series of driving waveforms. The lower chart of FIG. 10 shows the timings of outputting the series of driving waveforms in a second pass of the main scan. Dots are created in the pixels of odd ordinal numbers in response to the second series of driving waveforms and in the pixels of even ordinal numbers in response to the first series of driving waveforms. In this manner, each raster line is formed by two passes of the main scan having different mappings of the driving waveforms to the pixels in the intermediate print mode. In this embodiment, the output timings of the first series of driving waveforms are adjusted to create the respective dots on the center of the pixel at the resolution of 360 dpi in the intermediate print mode.

The intermediate print mode uses both the first series of driving waveforms and the second series of driving waveforms to create five variable-size dots, that is, a dot of 5 ng (corresponding to the driving waveform A1), a dot of 10 ng (corresponding to the driving waveform A2), a dot of 20 ng (corresponding to the driving waveform A3), a dot of 40 ng (corresponding to the driving waveforms B2 and B3), and a dot of 80 ng (corresponding to the driving waveforms B1 through B4). In the intermediate print mode, all these five dots may be used or part of these dots may be used selectively.

Figure 11:
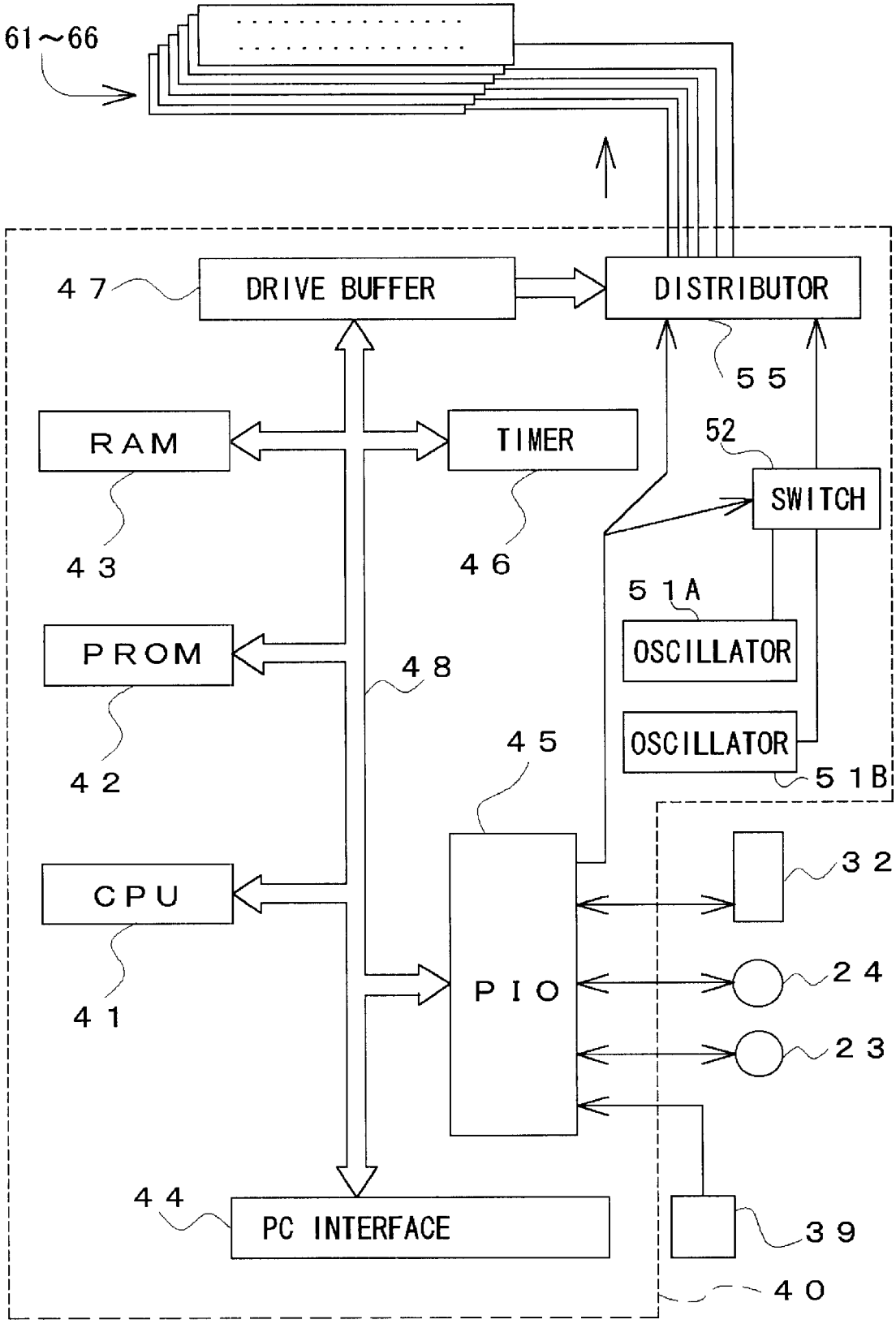
FIG. 11 illustrates the internal structure of a control circuit in the printer PRT.

The control circuit 40 has the internal structure discussed below to enable the output of the driving waveforms in the above manner. FIG. 11 shows the internal structure of the control circuit 40. The control circuit 40 includes a CPU 41, a PROM 42, a RAM 43, a PC interface 44 that carries out transmission of data to and from the computer PC, a peripheral input-output unit (PIO) 45 that carries out transmission of signals to and from the sheet feed motor 23, the carriage motor 24, and the control panel 32, a timer 46 that counts the time, and a drive buffer 47 that outputs dot on-off signals to the ink ejection heads 61 through 66. These elements and circuits are mutually connected via a bus 48.

The relationship between the tone values TN of the print data and the driving waveforms with regard to each print mode as shown in FIGS. 6 and 7 is stored in the form of a table in either the PROM 42 or the RAM 43. For example, in the high-quality print mode, 3-bit data are stored to represent the on-off conditions of the driving waveforms A1 through A3 according to the tone value. The first bit corresponds to the on-off state of the driving waveform A1, the second bit to the on-off state of the driving waveform A2, and the third bit to the on-off state of the driving waveform A3. In the high-speed print mode, 3-bit data are stored to represent the on-off conditions of the driving waveforms B1 through B4 according to the tone value. In the intermediate print mode, 6-bit data are stored to represent the on-off conditions of the driving waveforms A1 through A3 and B1 through B4 according to the tone value. The CPU 41 receives print data through the PC interface 44, refers to each table corresponding to the print mode, and converts the print data into the 3-bit or 6-bit data representing the on-off conditions of the respective driving waveforms (hereinafter referred to as the driving waveform-converted data), and transfers the driving waveform-converted data to the drive buffer 47.

The control circuit 40 includes an oscillator 51A that outputs the first series of driving waveforms and another oscillator 51B that outputs the second series of driving waveforms. The control circuit 40 also has a distributor 55 that distributes the outputs from the oscillators 51A and 51B into sectional outputs to the ink ejection heads 61 through 66 at a preset timing. The driving waveforms generated by these oscillators 51A and 51B are output to the distributor 55 via a switch 52. The switch 52 is controlled by the CPU 41 via the PIO 45 and selectively switches the outputs of the oscillators 51A and 51B with regard to each pixel according to the print mode.

In the high-quality print mode, the switch 52 outputs only the driving waveforms output from the oscillator 51A to the distributor 55 as shown in FIG. 8. In the high-speed print mode, the switch 52 outputs only the driving waveforms output from the oscillator 51B to the distributor 55 as shown in FIG. 9. In the intermediate print mode, the driving waveforms output from the oscillators 51A and 51B are switched over at every pixel of 360 dpi and alternately output to the distributor 55. In a first pass of the main scan, the output from the oscillator 51A is transmitted preferentially. In a second pass of the main scan, the output from the oscillator 51B is transmitted preferentially. This arrangement ensures output of the two different series of driving waveforms by changing the relationship between the pixel and the driving waveforms. In the intermediate print mode, the oscillator 51A outputs the driving waveforms by shifting the output timings, so that dots are created on the centers of the respective pixels of 360 dpi in response to the first series of driving waveforms. A delay circuit may be interposed to function in the intermediate print mode.

As described previously, the CPU 41 receives the print data processed by the computer PC, temporarily stores the processed print data into the RAM 43, translates the processed print data into the driving waveform-converted data, and outputs the driving waveform-converted data to the drive buffer 47. The drive buffer 47 outputs the driving waveform-converted data to the distributor 55 at a preset timing according to the print mode. The driving waveforms are accordingly output to each nozzle, so as to create a variety of dots according to the print mode.

In the printer PRT having the hardware structure discussed above, while the sheet feed motor 23 feeds the sheet of printing paper P (hereinafter referred to as the sub-scan), the carriage motor 24 reciprocates the carriage 31 (hereinafter referred to as the main scan), simultaneously with actuation of the piezoelectric elements PE on the respective ink ejection heads 61 through 66 of the print head 28. The printer PRT accordingly ejects the respective color inks to create dots, and thereby forms a multi-color image on the printing paper P.

In this embodiment, the printer 22 has the print head that uses the piezoelectric elements PE to eject ink as discussed previously. The printer may, however, apply another method for ink ejection. The technique of the present invention is applicable, for example, to a printer that supplies electricity to a heater disposed in an ink conduit and utilizes the bubbles generated in the ink conduit to eject ink.

Figure 12:
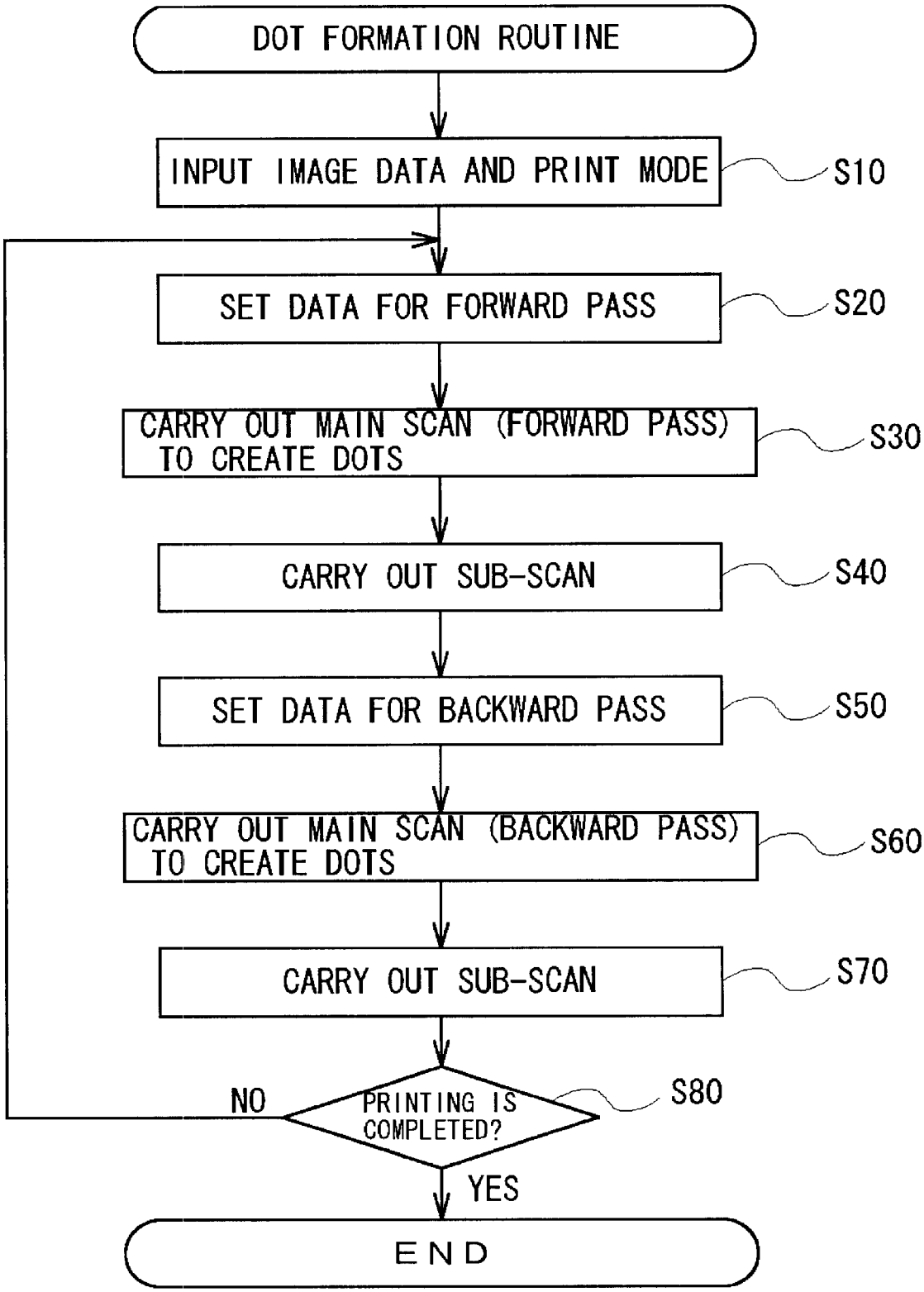
FIG. 12 is a flowchart showing a dot formation routine.

FIG. 12 is a flowchart showing a dot formation routine that is executed by the CPU 41 of the printer PRT. In this embodiment, the printer PRT creates dots both in the forward pass and the backward pass of the print head in the main scan. Hereinafter this recording technique is referred to as bi-directional recording. Dots may alternatively be created only in either one of the forward pass and the backward pass.

When the program enters this routine, the CPU 41 first inputs print data and a selected print mode (step S10). The print data are processed by the computer PC and represent the density TN in the range of 0 to 3, which is to be expressed by each ink used in the printer PRT with regard to each of the pixels constituting an image.

The CPU 41 temporarily stores the input print data into the RAM 43, sets the driving waveform-converted data for the forward pass, which are successively output to the respective nozzles in the forward pass, in the drive buffer 47 (step S20), and moves the print head forward for the main scan to create dots (step S30). The CPU 41 subsequently feeds the printing paper by a predetermined feeding amount to implement the sub-scan (step S40), sets the driving waveform-converted data for the backward pass (step S50), and moves the print head backward for the main scan to create dots (step S60). On completion of the dot formation, the sub-scan is performed (step S70). The above series of processings is repeated until a printing operation is concluded to complete an image (step S80). The method of setting the data for the forward pass and the data for the backward pass and the feeding amount in the sub-scan depend upon the print mode. Such settings are discussed below with regard to the respective print modes.

In the high-quality print mode, each raster line is formed by two passes of the main scan as shown in FIG. 8. The CPU 41 accordingly extracts the print data with regard to pixels of odd ordinal numbers in each raster line to set the data for the forward pass. The data for the backward pass are set, based on the print data with regard to pixels of even ordinal numbers in each raster line.

Figure 13:
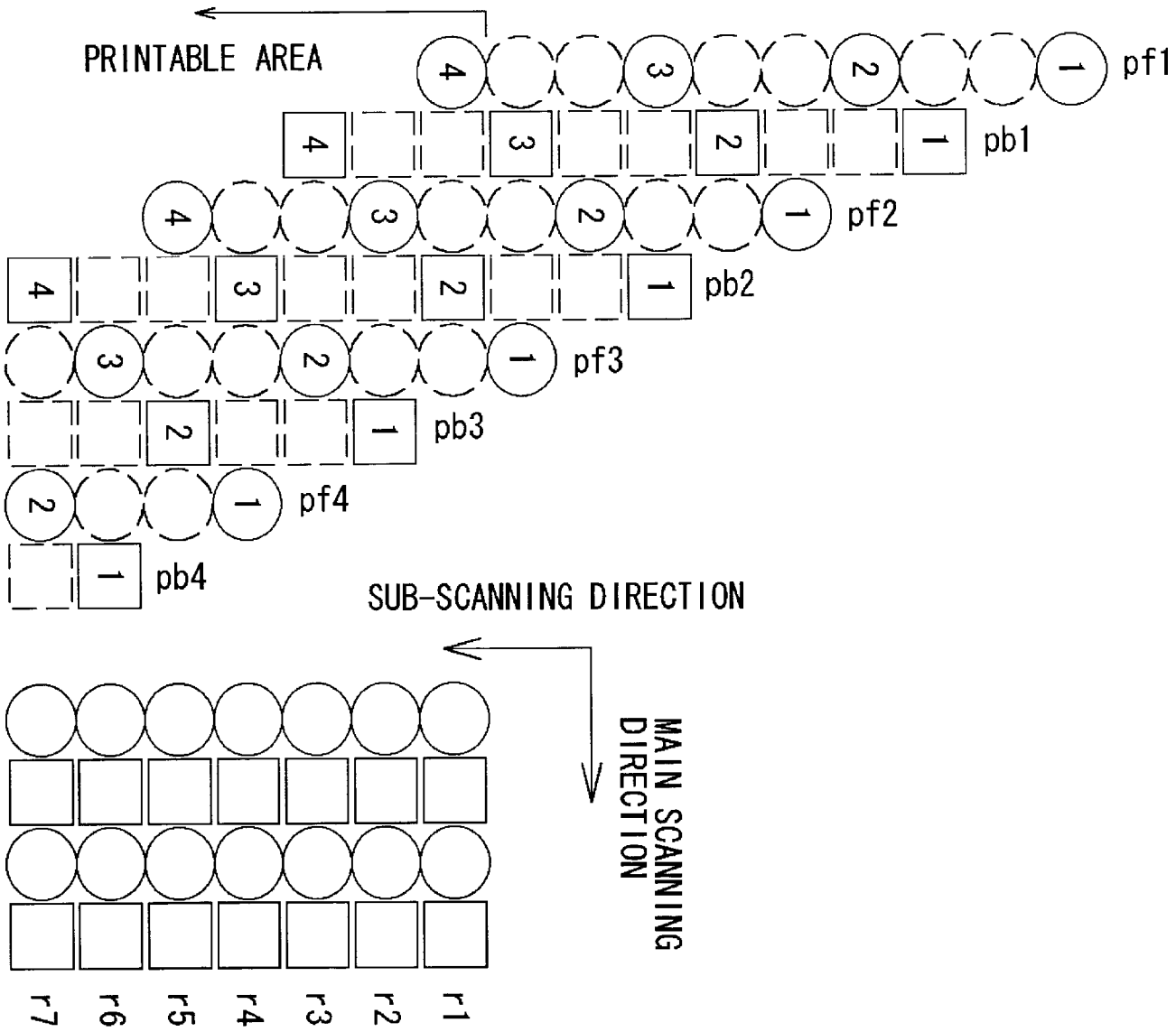
FIG. 13 shows formation of dots in the embodiment of the present invention.

FIG. 13 shows the formation of dots in the high-quality print mode. The left portion of the drawing shows the positions of the print head in the sub-scanning direction at respective passes pf1 through pf4 and pb1 through pb4 of the main scan. For convenience of illustration, it is assumed that the print head has four nozzles arranged at a nozzle pitch of 4 dots. Circular and square symbols with encircled figures represent nozzles. The numerals denote the nozzle numbers allocated to the respective nozzles. In the high-quality print mode, the first pass pf1 of the main scan moves the print head forward, that is, rightward in the drawing, to create dots with the No. 4 nozzle. After the sub-scan by a feed of 2 raster lines, the second pass of the main scan moves the print head backward, that is, leftward in the drawing, to create dots. The process forms dots while carrying out the sub-scan by the feed of 2 raster lines, so that each raster line is formed by a total of two passes of the main scan, that is, one forward pass and one backward pass, in a printable area. The right portion of the drawing shows the dots thus created. The circular symbols represent dots created in the forward pass, and the square symbols represent dots created in the backward pass. This example uses the four nozzles. In any arbitrary number of nozzles, however, the feeding amount is set to enable each raster line to be formed by two passes of the main scan.

In the high-speed print mode, each raster line is formed by one pass of the main scan as shown in FIG. 9. The CPU 41 thus successively sets the driving waveform-converted data with regard to all the pixels on each raster line corresponding to the nozzle position in the forward pass or the backward pass as the data for the forward pass or the data for the backward pass. Formation of dots in the high-speed print mode is described with the drawing of FIG. 13. In the high-speed print mode, each raster line is formed by one pass of the main scan, so that the sub-scan is carried out by a feeding amount that is double the feeding amount in the high-quality print mode. In the example of FIG. 13, the sub-scan is carried out by a feeding amount of 4 raster lines. The nozzles are accordingly located at the positions defined by the passes pf1 through pf4 of the main scan in FIG. 13. In the high-speed print mode, the print head is not located in any of the positions defined by the passes pb1 through pb4 of the main scan. Such feeding in the high-speed print mode causes all the dots on a raster line r1 to be formed by the No. 4 nozzle in the first pass of the main scan. Namely, data of all the pixels on the raster line r1 are the data for the forward pass. The process subsequently carries out the sub-scan by the feeding amount of 4 raster lines and forms all the dots on a raster line r2 with the No. 3 nozzle and all the dots on a raster line r5 with the No. 4 nozzle in a second pass of the main scan. Namely, data of all the pixels on the raster lines r2 and r5 are the data for the backward pass. The process forms each raster line by one pass of the main scan in this manner, so as to complete a printed image.

Figure 14:
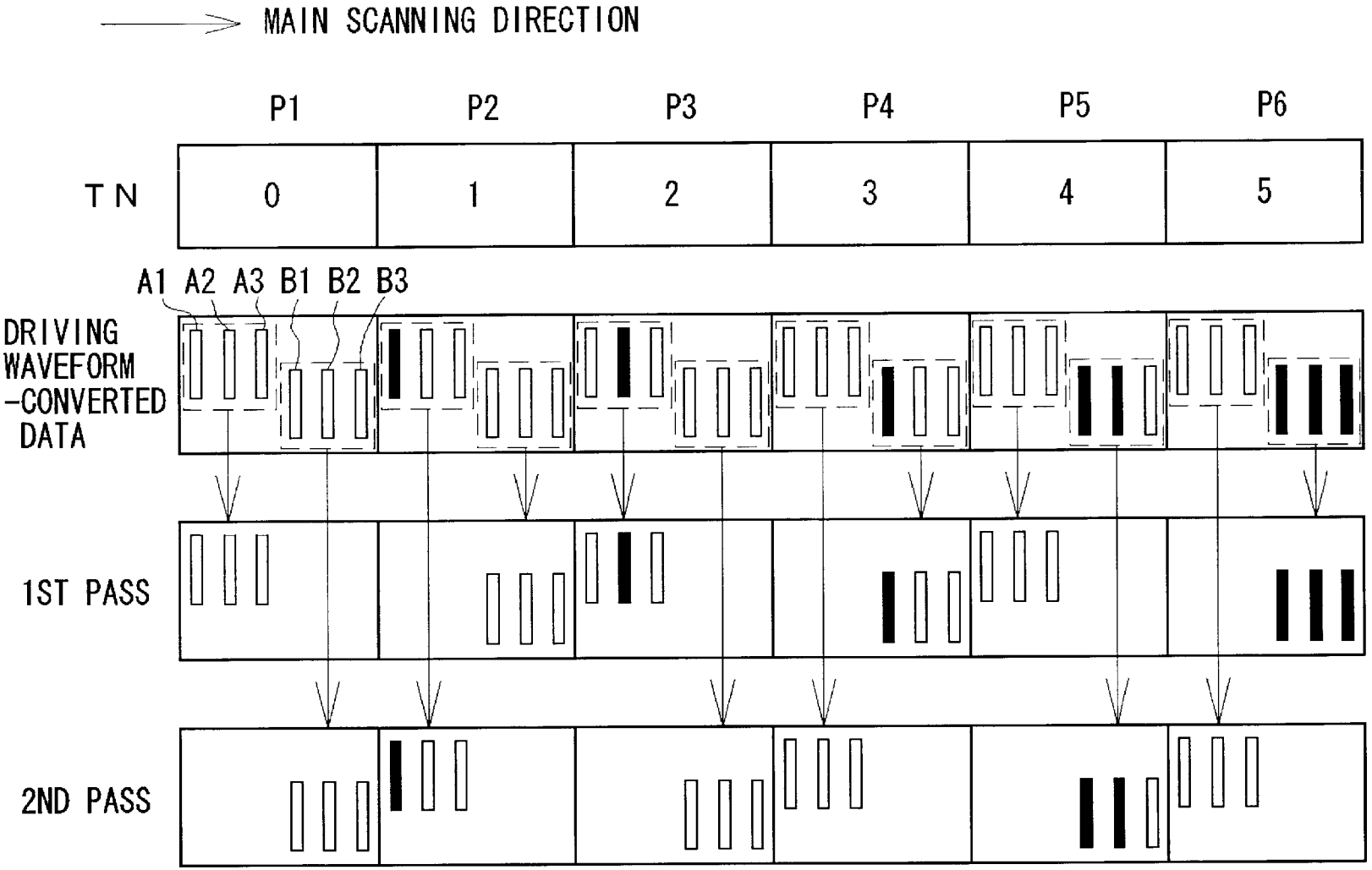
FIG. 14 shows the settings of data to be transferred to a drive buffer in the intermediate print mode.

In the intermediate print mode, each raster line is formed by two passes of the main scan as shown in FIG. 10. The feeding amount of the sub-scan in the intermediate print mode is accordingly identical with that in the high-quality print mode. Unlike the high-quality print mode, however, the intermediate print mode sets the print data with regard to all the pixels on each raster line in each pass of the main scan. FIG. 14 shows an example of setting the print data. In this example, print data TN in a value range of 0 to 5 are given to six pixels P1 to P6 aligned in the main scanning direction.

As described previously, the intermediate print mode creates dots in the respective pixels with both the first series driving waveforms A1 through A3 (see FIG. 6) and the second series of driving waveforms B1 through B3 (see FIG. 7). Namely, six different stages of densities including creation of no dot are expressed in each pixel.

The CPU 41 converts the print data TN of the respective pixels into 6-bit driving waveform-converted data corresponding to the on-off conditions of the driving waveforms A1 through A3 and B1 through B3 and stores the 6-bit driving waveform-converted data into the RAM 43. FIG. 14 shows the driving waveform-converted data. Rectangles A1 through A3 and B1 through B3 represent bits specifying the on-off conditions of the respective driving waveforms. The closed rectangle denotes the on condition of the driving waveform, and the open rectangle denotes the off condition of the driving waveform.

As shown in FIG. 14, all the driving waveforms are off in the pixel P1 having the print data TN equal to 0. Only the driving waveform A1 is on in the pixel P2 having the print data TN equal to 1. In a similar manner, the on-off conditions of the driving waveforms with regard to the print data TN in the value range of 2 to 5 are specified by the 6-bit data. In the drawing of FIG. 14, for the purpose of clear distinction, the upper 3 bits corresponding to the first series of driving waveforms A1 through A3 is vertically shifted in position from the lower 3 bits corresponding to the second series of driving waveforms B1 through B3.

In the first pass of the main scan, as shown in FIG. 10, the first series of driving waveforms A1 through A3 are output to the pixels of the odd ordinal numbers P1, P3, and P5, whereas the second series of driving waveforms B1 through B3 are output to the pixels of the even ordinal numbers P2, P4, and P6. The CPU 41 accordingly sets the upper 3 bits corresponding to the first series of driving waveforms A1 through A3 among the driving waveform-converted data as the data of the first pass of the main scan to be transferred to the drive buffer 47 with regard to the pixels of the odd ordinal numbers P1, P3, and P5 as shown in FIG. 14. With regard to the pixels of the even ordinal numbers P2, P4, and P6, the lower 3 bits corresponding to the second series of driving waveforms B1 through B3 are set as the data to be transferred to the drive buffer 47.

In the second pass of the main scan, on the contrary, the lower 3 bits corresponding to the second series of driving waveforms B1 through B3 among the driving waveform-converted data are set as the data to be transferred to the drive buffer 47 with regard to the pixels of the odd ordinal numbers P1, P3, and P5. With regard to the pixels of the even ordinal numbers P2, P4, and P6, the upper 3 bits corresponding to the first series of driving waveforms A1 through A3 are set as the data to be transferred to the drive buffer 47.

Another method applicable to set the print data in the intermediate print mode may determine whether or not the print data TN is to be set in response to the first series of driving waveforms with regard to each pixel. The technique of this embodiment sets the data to be transferred to the drive buffer 47 by specifying the bits of the driving waveform-converted data as discussed above, thereby attaining the quick processing. In the example described above, the print data TN have the six different values in the range of 0 to 5 in the intermediate print mode. The use of the driving waveform-converted data ensures application of the processing similar to that of FIG. 14 for any different set of tone values.

The printer PRT of the embodiment discussed above enables printing to be carried out in the third print mode or the intermediate print mode using the first series of driving waveforms directed to the high-quality printing and the second series of driving waveforms directed to the high-speed printing. The intermediate print mode performs printing at a low resolution identical with that of the high-speed print mode, thus ensuring the higher printing speed than that of the high-quality print mode. The intermediate print mode, however, requires two passes of the main scan to form each raster line, thus having the lower printing speed than the high-speed print mode that forms each raster line by one pass of the main scan only with the second series of driving waveforms. Namely, the intermediate print mode has the intermediate printing speed between the high-speed print mode and the high-quality print mode.

The following gives the resolution (in the main scanning direction x in the sub-scanning direction), the number of passes of the main scan, and the printing speed ratio relative to the printing speed in the high-speed print mode as criteria in each print mode of the embodiment:

High-speed print mode: Resolution: 360 dpi×360 dpi

Number of passes of main scan: 1

Printing speed ratio: 1

Intermediate print mode: Resolution: 360 dpi×360 dpi

Number of passes of main scan: 2

Printing speed ratio: ½

High-quality print mode: Resolution: 720 dpi×720 dpi

Number of passes of main scan: 2

Printing speed ratio: ¼

The intermediate print mode carries out printing with dots of a small quantity of ink, e.g. 5 ng, as in the high-quality print mode to enable smooth tone expression and ensure printing of better picture quality than that of the high-speed print mode that carries out printing only with dots of, e.g., not smaller than 20 ng. Since printing is carried out at a low resolution, however, the picture quality in the intermediate print mode is lower than that in the high-quality print mode. Namely, the intermediate print mode enables printing at an intermediate picture quality between those of the high-speed print mode and the high-quality print mode.

The printer PRT of the embodiment combines the existing print modes to attain a new print mode having different printing speed and picture qualities. For the new print mode, there is no necessity of increasing the number of oscillators used to output the driving waveforms. The manufacturing cost is accordingly not raised. This arrangement ensures printing according to the requirements of the user and significantly improves the usability of the printer PRT.

The printer PRT of this embodiment has advantages in manufacture as discussed below. At the time of manufacturing the printer PRT, the driving voltage is adjusted with regard to each driving waveform to ensure creation of dots with a substantially constant quantity of ink ejection. In the printer PRT of the embodiment, the driving voltage is regulated with regard to both the first series of driving waveforms and the second series of driving waveforms. The intermediate print mode uses the pre-adjusted two series of driving waveforms, and further adjustment of the driving voltage is not required. The printer PRT of this embodiment thus advantageously sets a new print mode without an additional step of adjusting the driving voltage.

In the printer PRT of the embodiment having the hardware structure including the switch 52, improvement and addition of print modes is readily attained by a simple change of the software. A printer driver in which mappings of the print data TN to the first and the second series of driving waveforms in a new print mode are incorporated is given to the user through a diversity of recording media, in order to readily improve the addition of the print mode. The user may define the new print mode through operations of the computer 90.

The printer PRT of the embodiment regulates the switch 52 to alternately output the first series of driving waveforms and the second series of driving waveforms to the respective pixels in the intermediate print mode. As described previously with respect to FIG. 10, the first pass of the main scan outputs the first series of driving waveforms and the second series of driving waveforms in this sequence, and the second pass of the main scan outputs the second series of driving waveforms and the first series of driving waveforms in this sequence.

Figure 15:
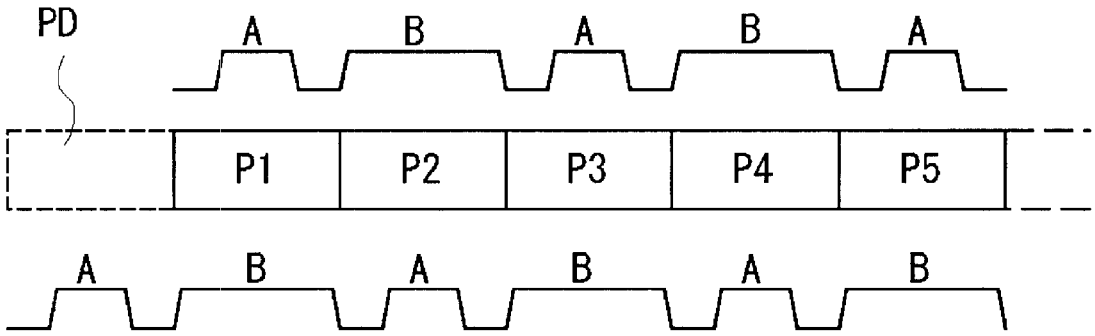
FIG. 15 shows a modified example of the output of driving waveforms in the intermediate print mode.

A variety of other methods may be applicable to differentiate the mappings of the driving waveforms to the pixels in each pass of the main scan. FIG. 15 shows a modified example to differentiate the mapping of the driving waveforms to the pixels. The upper chart shows a series of driving waveforms in a first pass of the main scan, and the lower chart shows a series of driving waveforms in a second pass of the main scan. The driving waveforms are always output in the sequence of the first series of driving waveforms (A) and the second series of driving waveforms (B). The modified example shifts the start timing of printing in the second pass of the main scan from that in the first pass of the main scan. In the second pass of the main scan, there is a dummy pixel PD, which is not actually printed, on the left of the pixel P1, on which printing is started originally. Outputting the driving waveforms to start printing from this dummy pixel PD enables the driving waveforms to be output to the pixel P1 and the subsequent pixels in different mappings from those of the first pass of the main scan. In this case, as discussed previously with respect to FIG. 10, it is desirable to adjust the output timings of the first series of driving waveforms, in order to create dots respectively on the centers of pixels of 360 dpi.

Figure 16:
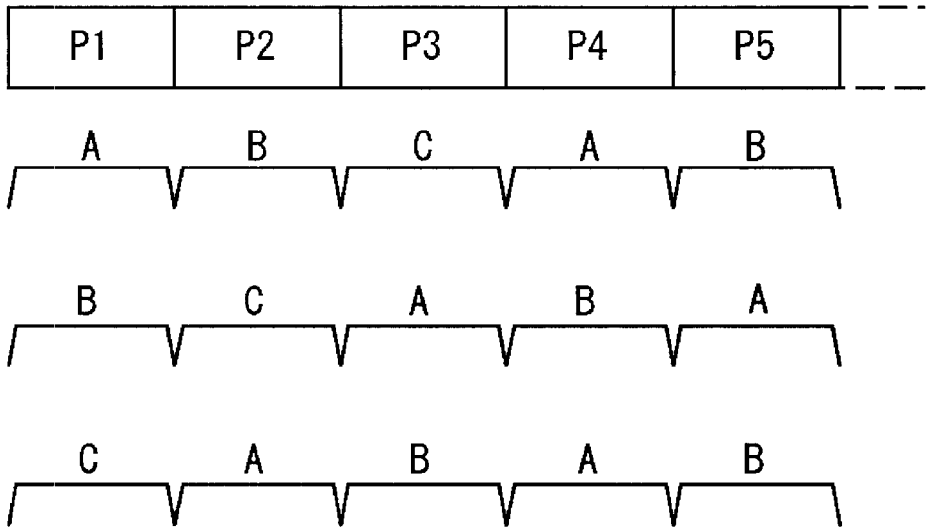
FIG. 16 shows a modified example of possible print modes by combination.

The printer PRT of the embodiment sets the intermediate print mode by combining the two series of driving waveforms with each other. Greater series of driving waveforms may alternatively be combined to set the intermediate print mode. FIG. 16 shows an example of combining three different series of driving waveforms. This modified example uses three different series of driving waveforms A, B, and C. A new print mode is defined by using all the three different series of driving waveforms. In a first pass of the main scan, the driving waveforms are output to pixels P1, P2, and P3 in the sequence of the series of driving waveforms A, B, and C. In a second pass of the main scan, the driving waveforms are output to the pixels P1, P2, and P3 in the sequence of the series of driving waveforms B, C, and A. In a third pass of the main scan, the driving waveforms are output to the pixels P1, P2, and P3 in the sequence of the series of driving waveforms C, A, and B. In general, in the case where "n" series of driving waveforms are combined (where "n" is an integer of not less than 2), each raster line is formed by "n" passes of the main scan having different mappings of the driving waveforms to the respective pixels. This attains printing in a new print mode.

The modified example discussed above uses the three different series of driving waveforms. Another modified process may set new print modes by combining two out of the three different series of driving waveforms A, B, and C. This modification ensures settings of various print modes by combining the series of driving waveforms A with the series of driving waveforms B, by combining the series of driving waveforms B with the series of driving waveforms C, and by combining the series of driving waveforms A with the series of driving waveforms C. This arrangement provides a print mode more suitable for the printing requirements of the user.

The technique of the embodiment successively outputs the first series of driving waveforms and the second series of driving waveforms over two pixels in each pass of the main scan in the intermediate print mode. One modified process uses only the first series of driving waveforms to record all the pixels on a raster line in the first pass of the main scan and only the second series of driving waveforms to record all the pixels on another raster line in the second pass of the main scan. This modified process readily sets the data to be output to the drive buffer 47. In the case that pixels having the printer data TN equal to 1 are consecutively aligned in the main scanning direction, for example, this area is printed with a single nozzle in the first pass of the main scan. This arrangement thus does not sufficiently exert the overlap effects. The method of this embodiment, however, enables each raster line to be formed with two different nozzle even in such a case, thus ensuring the overlap effects to improve the picture quality.

As long as the driving frequency is in an allowable range, the first series of driving waveforms and the second series of driving waveforms may be output consecutively to each pixel in the intermediate print mode. This arrangement reduces the number of passes of the main scan in the intermediate print mode, thereby improving the printing speed. The method of the embodiment, however, enables combination of the driving waveforms without any restriction of the driving frequency and thus sets a diversity of print modes more flexibly.

The above embodiment regards the printer that uses piezoelectric elements to eject ink. The principle of the present invention is, however, not restricted to this type of printer, but is applicable to a variety of other printers, for example a printer that supplies electricity to a heater disposed in an ink conduit and utilizes the bubbles generated in the ink conduit to eject ink. The technique of the present invention is also applicable to a thermal transfer printer, a sublimation printer, an impact dot matrix printer, and a diversity of other printers.

The multi-valued printer that enables expression of three or more different densities in each pixel in each print mode is discussed in the above embodiment. The technique of the present invention may be applicable to a printer that uses only a single type of dot in one print mode. Such a printer uses, for example, only the driving waveform A1 shown in FIG. 6 in the high-quality print mode and only the driving waveform B1 shown in FIG. 7 in the high-speed print mode.

The present invention is not restricted to the above embodiment or its modifications, but there may be many other modifications, changes, and alterations without departing from the scope or spirit of the main characteristics of the present invention. For example, the series of control processes described in the embodiment may partly or wholly be attained by a hardware configuration.

The technique of the present invention is applicable to a printing apparatus that creates dots to print an image on a printing medium and has a plurality of print modes, in which different types of dots may be created in respective pixels.

What is claimed is:

1. A printing apparatus that moves a print head back and forth relative to one axis of a printing medium in response to a driving signal, so as to create a dot in each pixel and print an image on said printing medium, said printing apparatus comprising:

n output units configured to periodically output driving signals corresponding to n different print modes (where n is an integer of not less than 2), in which different dots are created in each pixel; and a mixing output unit configured to periodically use m output units (where m is an integer satisfying $2 \leqq m \leqq n$), which are selected out of said n output units to mix output driving signals from each of said m output units, thereby outputting a specific driving signal that is used in a specific print mode, which is different from any of the n different print modes.

2. A printing apparatus in accordance with claim 1, wherein said mixing output unit periodically uses said m output units during one pass of said print head.

3. A printing apparatus in accordance with claim 2, wherein said mixing output unit causes said m output units to output driving signals over m pixels, said printing apparatus further comprising:

a control unit configured to control said mixing output unit to output driving signals to ensure different mappings of said output units to respective pixels during m passes of said print head, thus enabling m different driving signals to be output with regard to each pixel.

4. A printing apparatus in accordance with claim 1, wherein said output unit outputs a driving signal of a specific frequency that corresponds to a maximum possible number of dots created in each pixel during one pass of said print head, in response to a driving frequency of said print head.

5. A printing apparatus in accordance with claim 1, wherein at least one of said output units outputs a specific driving signal that enables a plurality of dots including a maximum-sized dot created by said print head to be formed in each pixel.

6. A printing apparatus that moves a print head back and forth relative to one axis of a printing medium in response to a driving signal, so as to create a dot in each pixel and print an image on said printing medium, said printing apparatus comprising:

output means for outputting driving signals corresponding to n different print modes, in which different dots are created in each pixel; and mixing means for periodically using a portion of said output means to mix output driving signals from said output means, to output a specific driving signal that is used in a specific print mode, which is different from any of the n different print modes.

7. A printing apparatus in accordance with claim 6, further comprising:

control means for controlling said mixing means to output driving signals to ensure different mappings of said output means to respective pixels during m passes of said print head, thus enabling m different driving signals to be output with regard to each pixel.

8. A method of moving a print head back and forth relative to one axis of a printing medium in response to a driving signal output from a predetermined output unit, so as to create a dot in each pixel and print an image on said printing medium, said method comprising the steps of:

(a) selecting a print mode among n different preset print modes, in which different dots are created in each pixel, and specifying the selected print mode;

(b) when preset n print modes are specified (where n is an integer satisfying $2 \leqq n < N$), causing a driving signal to be output periodically from an output unit corresponding to each of the preset n print modes, and thereby implement printing; and (c) when a print mode other than the preset n print modes is specified, carrying out printing by periodically using at least two output units to mix output driving signals from said at least two output units, which are set in advance corresponding to the specified print mode.

9. A recording medium, in which a specific program is recorded in a computer readable manner, said specific program being used to drive a printing apparatus that moves a print head back and forth relative to one axis of a printing medium in response to a driving signal output from a predetermined output unit, so as to create a dot in each pixel and print an image on said printing medium, said specific program comprising data that represent mappings of a plurality of output units to a plurality of print modes, wherein at least two output units are mapped to at least one print mode to mix output driving signals from said at least two output units.

* * * * *